United States Patent [19]

Erickson, II et al.

[11] Patent Number: 4,842,530

[45] Date of Patent: Jun. 27, 1989

[54] ELECTRICAL FLOATING BOND ASSEMBLY

[75] Inventors: David J. Erickson, II, Raymond, N.H.; Michael G. Naylor, Mounds View, Minn.; Robert R. Knobloch, Jamestown, N.Y.

[73] Assignee: The Dexter Corporation, Windsor Locks, Conn.

[21] Appl. No.: 149,572

[22] Filed: Jan. 28, 1988

[51] Int. Cl.[4] ..... H01R 4/66

[52] U.S. Cl. ..... 439/98; 439/779

[58] Field of Search ..... 439/96, 98, 99, 100, 439/778–780, 877; 174/94 R, 94 S

[56] References Cited

U.S. PATENT DOCUMENTS

| | | | |
|---|---|---|---|
| 822,492 | 6/1906 | Turner . | |
| 1,677,783 | 7/1928 | Kearney | 439/780 |
| 1,993,391 | 3/1935 | Weaver, Jr. | 173/263 |
| 2,137,834 | 11/1938 | Dibner | 173/263 |
| 2,197,000 | 4/1940 | MacLean | 24/135 |
| 2,913,699 | 11/1959 | Cushenberry | 439/779 |
| 3,093,435 | 6/1963 | Johnson | 439/877 |
| 3,260,987 | 7/1966 | Gunthel, Jr. | 439/779 |
| 3,534,318 | 10/1970 | O'Leary | 439/96 |
| 3,771,112 | 11/1973 | Thompson et al. | 439/778 |

FOREIGN PATENT DOCUMENTS

| | | | |
|---|---|---|---|
| 852871 | 10/1952 | Fed. Rep. of Germany | 439/877 |

OTHER PUBLICATIONS

Southwestern Bell Telephone "SWB Floating Bond Assembly".

*Primary Examiner*—Gary F. Paumen

*Attorney, Agent, or Firm*—Fish & Richardson

[57] ABSTRACT

An electrical floating bond comprising a slotted bolt coupled, preferably by an integral rivet, to one end of a short wire. The bolt is slotted along a threaded portion of the bolt for receiving a cable or cables with an exposed conductive sheath. A ring nut clamps a cable or cables in the slotted bolt.

1 Claim, 3 Drawing Sheets

ELECTRICAL FLOATING BOND ASSEMBLY

BACKGROUND OF THE INVENTION

The invention relates to a floating bond for providing an electrical and mechanical connection between a terminal post and a cable with a conductive sheath.

A standard outdoor residential telephone cable or buried service wire comprises a number of electrical wires, which are individually insulated and bound together by a protective armored metallic sheath surrounding the bundle of wires. The sheath is typically made of copper and serves as a ground. An outer insulating sleeve encases the sheath and protects the cable from the environment.

A standard residential network interface box, usually found on the outside of a house or pedestal (cable closure), contains telephone line terminals to which the wires in the telephone cable are connected and a ground terminal in the form of a threaded post to which the sheath is connected. In the past, the sheath was mounted directly to the ground post. Phone company service personnel accomplished this on-site by splitting the sheathing axially, spreading it open and punching a hole in it, allowing the sheath to be slipped over the post like a washer and secured in place with a nut.

SUMMARY OF THE INVENTION

As a general feature of the invention, an electrical floating bond forms an easily installed, flexible link between a ground terminal and the conductive sheath of a cable. A conductive slotted bolt has an externally threaded end with a central axial slot and a head end connected to a flexible wire. The free end of the wire is connected to the ground terminal. The cable with its sheath exposed is inserted into the slot at right angles to the bolt and secured with a nut.

Preferred embodiments of the invention include the following features. The floating bond comprises a conducting wire having a flat hook terminal coupled to the free end of the wire and a flat eye wire terminal coupled to the other end of the wire. The slotted bolt is coupled to the flat eye wire terminal by means of an integral rivet. A cylindrical boss formed along the major axis of the bolt is inserted in the eye of the wire terminal The end of the boss is flattened against the wire terminal to secure the wire to the bolt. The slotted bolt has a slot along a threaded portion of the bolt for receiving the sheathed cable. A ring nut is threadingly received on the threaded portion of the bolt and clamps the cable to the bolt.

The electrical floating bond facilitates connection of one or more cable sheaths to the ground terminal. In addition to eliminating the need to open and punch the sheath, it reduces the surface area of the connection lowering the risk of electrical shorts and, moreover, leaves the cable end free to be manipulated or move, due to frost heave, for example, acting on the buried cable itself, while anchored to the ground terminal.

Other advantages and features will become apparent from the following description of the preferred embodiment and from the claims.

DESCRIPTION OF THE PREFERRED EMBODIMENTS

DRAWINGS

The drawings are briefly described as follows.

STRUCTURE

Figure 6:
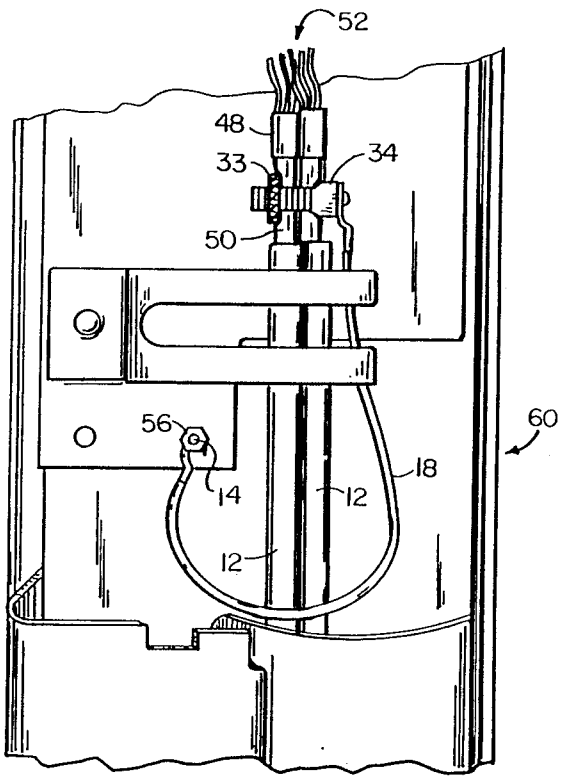
FIG. 6 is a perspective view of another floating bond assembly in a pedestal-type cable closure with its cover removed.

As shown in the accompanying drawings, an electrical floating bond 10 embodying the present invention is adapted for making a ground connection between a buried telephone service cable sheath 12 and a ground terminal 14 of a network interface box 16 (FIG. 5) located on the side of a building or a pedestal-type cable closure (FIG. 6).

As shown in FIGS. 1, 2, 3, 4A, and 4B, the floating bond 10 includes a short flexible wire 18. Preferably, the wire 18 is a standard ten gage multi-strand cable having, for example, 105 strands of thirty gage tin-coated copper wire. The wire 18 is covered with PVC insulation which is stripped at both ends, as shown, leaving approximately $\frac{3}{8}$ inch of the wire exposed at each end 20, 22. At one end 20, a tubular connector clamping shank 24 of a flat hook wire terminal 26 is fitted over the exposed wire and clamped firmly (as shown) to the wire using a crimping tool means. At the other end 22 of the wire 18, a tubular connector clamping shank 28 of a flat eye wire terminal 30 is similarly clamped to the exposed wire. Mounted to the eye wire terminal 30 is a slotted bolt and ring nut assembly 32. Preferably, assembly 32 is made of tin-coated brass or tin-coated copper. Terminals 26 and 30 are tin-coated copper or brass.

Figure 1:
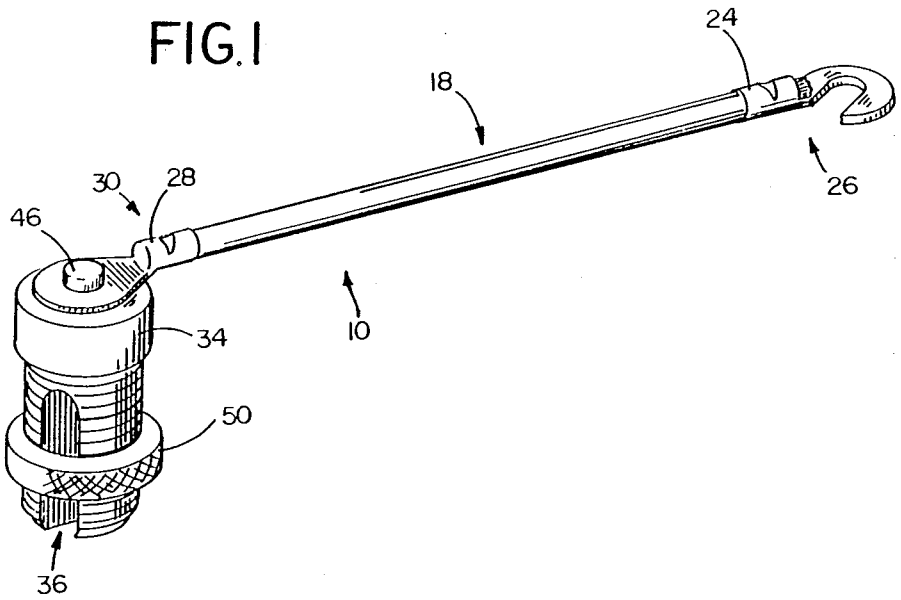
FIG. 1 is a perspective view of an electrical floating bond assembly according to the invention.
Figure 2:
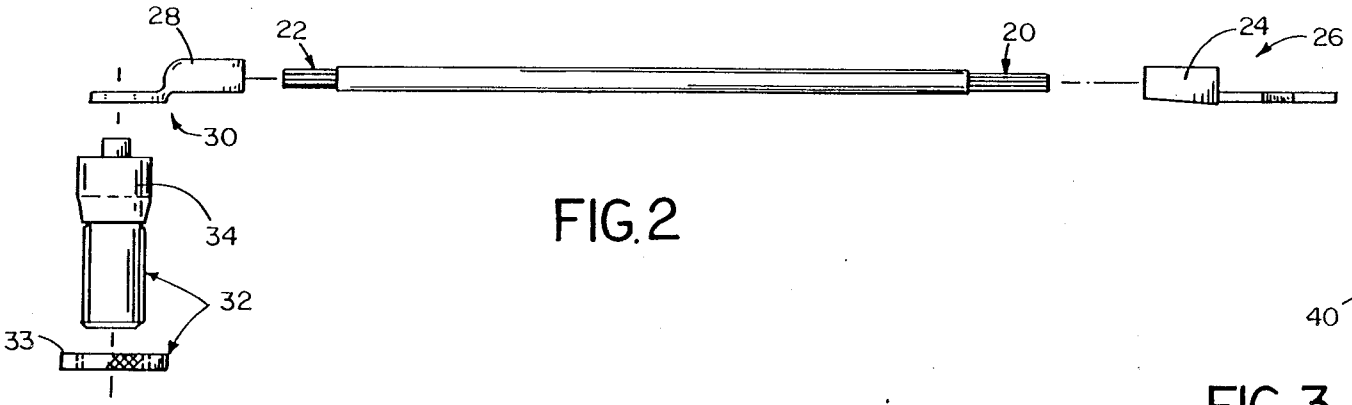
FIG. 2 is a dual axially exploded side view of the floating bond assembly of FIG. 1.
Figure 3:
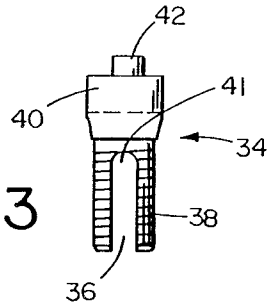
FIG. 3 is a side view of the slotted bolt and nut assembly of FIG. 2 rotated 90° to reveal the slot.
Figure 4A:
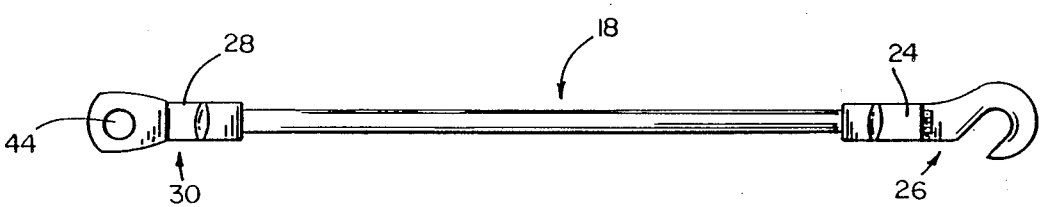
FIGS. 4A and 4B are plan and side views of the wire assembly of FIG. 1, respectively.
Figure 4B:
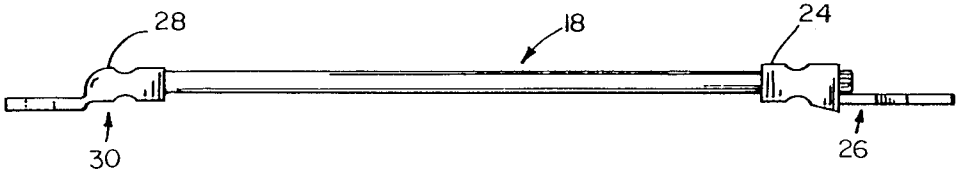

As shown in FIGS. 2 and 3, the slotted bolt and nut assembly 32 comprises a ring nut 33 and a bolt 34 having an axial slot 36 extending along a threaded section 38 and into the head section 40 as shown. The rounded closed end 41 of the slot is radiused to accommodate the outer diameter of the cable sheath. An integral coaxial cylindrical boss 42 sized to be received through the eye 44 of the flat eye wire terminal 30 is formed on the head section 40 of the bolt 34. The same screw machine which forms the threaded bolt can also form the boss 42. The slotted bolt 34 is mounted to the flat eye wire terminal 30 by fitting the cylindrical boss 42 through the eye 44 of the flat eye wire terminal 30 and striking the end of the boss to form a rivet head 46 over the flat eye terminal 30 (FIG. 1), which secures the bolt 34 to the wire 18. Preferably, the bolt 34 is secured to the wire terminal 30 so that the slot 36 is aligned with the initial direction of the wire 18 as defined by the wire terminal 30, as shown in FIG. 1.

Figure 5:
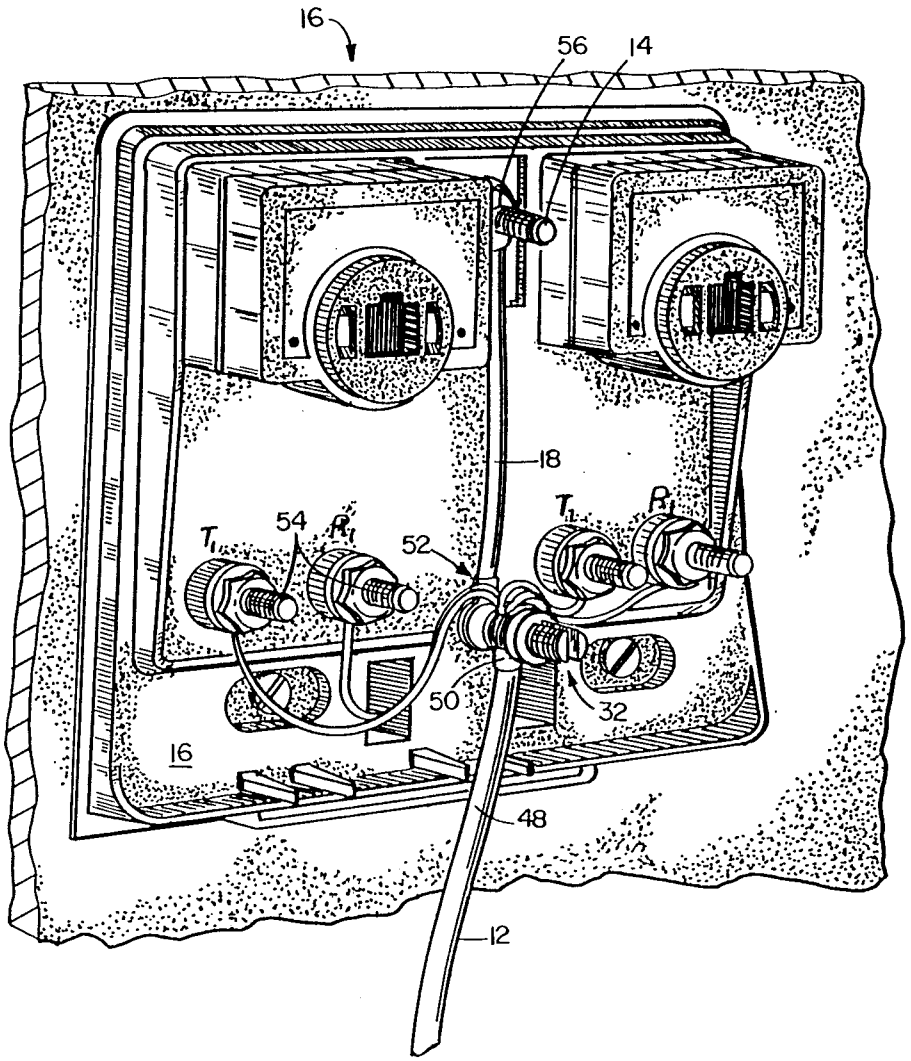
FIG. 5 is a perspective view of the floating bond assembly grounding a buried service wire in a network interface box (with its cover removed) mounted on the side of a building.

The floating bond assembly 10 is used to bridge the grounding sheath of a buried service phone cable 12 to the ground terminal 14 of a standard network interface box 16 (FIG. 5) or pedestal-type cable enclosure 60 (FIG. 6). As shown, exterior insulation 48 and metallic sheath 50 are removed to permit the individual wires 52 to be connected to phone terminals 54 (FIG. 5). An extra portion of insulation is removed so that sheath 50 of cable 12 extends beyond the exterior insulation 48 and is fitted within the slot 36 of the bolt 34 in FIG. 5. Alternatively, a section of insulation can be removed as in FIG. 6. The ring nut 33 is screwed onto the threaded portion 38 of the bolt 34 by hand and clamps the cable 12 firmly to the bolt 34 establishing good electrical contact. The flat hook wire terminal 26 is then hooked over the ground terminal 14 of the box 16 (FIG. 5) or pedestal 60 (FIG. 6) and secured by a nut 56.

Slot 36 is preferably long enough to accommodate several cables side-by-side, as shown in FIG. 6 for a typical pedestal 60 serving several residences, for example. The exposed sheaths of the cables are clamped together in slot 36 as shown.

Ground wire 18 is preferably about 4 ¾ inches long for the network interface box application of FIG. 5. In the pedestal application (FIG. 6), the length of the wire 18 is increased to about 10 ¾ inches.

Many variations on as well as additions to the illustrated embodiments are possible without departing from the principle of the invention. For example, if desired, hook terminal 26 can be replaced by a flat eye terminal which can be slipped over the ground terminal 14.

Other embodiments are within the following claims.

We claim:

1. An electrical floating bond for interconnecting an electrical conductive sheath of a cable to a ground terminal, comprising:

an electrically-conductive, axially slotted, externally-threaded bolt which slot is open at one end thereof corresponding to the threaded end of the bolt;

a nut threadingly engaging said threaded bolt;

at least one electrical conducting means comprising multiple, individually insulated, conductors surrounded by a conductive sheath surrounded in turn by insulation, firmly clamped in said slot between said nut and the closed end of said slot in such manner that only said sheath makes good electrical contact with said bolt, said insulated cable extending away from said bolt in one direction and said individual conductors, substantially free of said sheath and its surrounding insulation, extending away from said bolt in the other direction;

a substantially cylindrical boss extending from the closed end of said bolt substantially coaxially with said threading end and directed away from the open end of said slot;

a flexible electrical conductor having a substantially flat eye terminal at one end closely engaged about said boss and held in such close engaging relationship by a river integral with said bolt, and having a substantially flat hook-shaped terminal at the other end; and a ground conductor affixed to said hook-shaped terminal;

wherein said electrical conducting means is substantially rigidly positioned through said slotted bolt and said ground conductor is flexibly a nd movably related thereto through said flexible electrical conductor.

* * * * *